US008037732B2

(12) United States Patent
Shimoda et al.

(10) Patent No.: US 8,037,732 B2
(45) Date of Patent: Oct. 18, 2011

(54) METHOD OF PRODUCING SEAMLESS METAL TUBE AND PUNCH FOR USE THEREIN

(75) Inventors: Kazuhiro Shimoda, Osaka (JP); Tomio Yamakawa, Osaka (JP); Koji Muramatsu, Osaka (JP); Yuji Inoue, Osaka (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 12/748,744

(22) Filed: Mar. 29, 2010

(65) Prior Publication Data

US 2010/0175450 A1 Jul. 15, 2010

Related U.S. Application Data

(63) Continuation of application No. PCT/JP2008/072746, filed on Dec. 15, 2008.

(30) Foreign Application Priority Data

Mar. 31, 2008 (JP) ..... 2008-092200

(51) Int. Cl.
*B21D 3/00* (2006.01)
*B21B 19/08* (2006.01)

(52) U.S. Cl. ..... 72/367.1; 72/96

(58) Field of Classification Search ..... 72/95–97, 72/208, 209, 365.2, 366.2, 367.1, 368, 370.01, 72/324, 325, 370.1, 370.27
See application file for complete search history.

(56) References Cited

U.S. PATENT DOCUMENTS 1,465,073 A * 8/1923 Davis ..... 72/97
4,190,887 A * 2/1980 Yoshiwara et al. ..... 72/209

FOREIGN PATENT DOCUMENTS

| | | |
|---|---|---|
| JP | 59-148102 | 10/1984 |
| JP | 62-199201 | 12/1987 |
| JP | 7-214112 | 8/1995 |
| JP | 7-214113 | 8/1995 |
| JP | 2001-219205 | 8/2001 |

* cited by examiner

*Primary Examiner* — Teresa Ekiert
(74) *Attorney, Agent, or Firm* — Clark & Brody

(57) ABSTRACT

A hole 30 is formed in the center of the rear end face 20 of a round billet 10. The hole 30 has a predetermined depth from the rear end face 20 and a plurality of grooves 31 are provided in the side surface thereof. Each groove 31 extends in the depth direction of the hole 30. Piercing and rolling of the round billet 10 having the hole 30 is performed using a piercing mill having a plug. During piercing and rolling, the bottom surface of the hole 30 is broken through by the plug and a protrusion which is to be the starting point of burrs is formed, and the protrusion is absorbed by the groove 31 as the plug advances. Consequently, formation of burrs at the rear end of a hollow shell after piercing-rolling thereof can be suppressed.

7 Claims, 11 Drawing Sheets

METHOD OF PRODUCING SEAMLESS METAL TUBE AND PUNCH FOR USE THEREIN

This application is a continuation of International Patent Application No. PCT/JP2008/072746, filed Dec. 15, 2008. This PCT application was not in English as published under PCT Article 21(2).

TECHNICAL FIELD

The present invention relates to a method of producing a seamless metal tube and a punch for use in the method. More particularly, the present invention relates to a method of producing a seamless metal tube using a piercing mill, and a punch for use in the method.

BACKGROUND ART

One of the methods of producing a steel tube is to use a piercing mill to produce a seamless metal tube. The piercing mill includes a plurality of conical rolls disposed at equal intervals around a pass line and a plug disposed on the pass line between the plurality of conical rolls.

The method of producing a seamless metal tube using the piercing mill is as described below. First, a heated round billet is prepared and placed on the pass line. The round billet is pushed in between the plurality of conical rolls by using a pusher disposed in front of the piercing mill. Once the round billet is engaged with the plurality of conical rolls, the round billet is pierced and rolled through the conical rolls with the plug while the billet is spirally rotated to produce a hollow shell.

During piercing-rolling, the plug pierces the round billet. When the plug front end comes out of the rear end of the round billet, a portion of steel on the rear end part of the round billet, with which the plug front end has been in contact until the plug front end comes out, is broken through. The portion of steel broken through may remain as burrs on the inner surface or on the end part of the hollow shell.

The burrs may induce inner surface flaws on the hollow shell during the rolling processes involving an elongator, a sizing mill, and the like, performed after piercing-rolling.

Methods of preventing the formation of such burrs have been disclosed in JP59-148102U, JP62-199201U, and JP7-214112A. In the methods disclosed in these documents, a hole having a predetermined depth is formed in the center at the rear end of the round billet using a punch or gas before piercing-rolling. Then, the piercing-rolling is performed on the round billet in which the hole has been formed. With the hole formed in the center at the rear end of the round billet, excess material that may form burrs can be removed, and consequently the formation of burrs can be suppressed.

Another method different from the aforementioned methods has been disclosed in JP7-214113A. In this method, the piercing-rolling is performed on a round billet having a single-slot or cross-slot groove formed on the rear end face thereof. According to this document, since the single-slot or cross-slot groove is formed on the rear end face, there is less or no excess material in the central region of the end face, so that the formation of burrs can be suppressed.

In sum, according to the methods described in these documents, by scraping the center at the rear end of the billet, excess material that may form burrs can be reduced to suppress the formation of burrs.

In some cases, however, even if any of these methods is employed, burrs are still formed.

DISCLOSURE OF THE INVENTION

An object of the present invention is to provide a method of producing a seamless metal tube, which method can restrain burrs from being formed at the rear end of a hollow shell after piercing-rolling.

The method of producing a seamless metal tube in accordance with the present invention uses a piercing mill including a plurality of conical rolls and a plug disposed between the plurality of conical rolls. The method of producing a seamless metal tube of the present invention includes the steps of preparing a billet; forming a hole, which has a predetermined depth in the axial direction of the billet and has a groove in the inner surface thereof, in the center at the rear end of the billet; and piercing and rolling the billet formed with the hole from the front end by the piercing mill.

In the method of producing a seamless metal tube in accordance with the present invention, a groove is formed in the inner surface of the hole. When the front end of the plug breaks through the bottom surface part of the hole at the rear end of the billet during piercing-rolling, a portion of steel of the broken-through bottom surface tends to form a protrusion that may become the starting point of burrs. However, the portion of steel that may become the protrusion is absorbed by the groove formed in the inner surface of the hole. Further, by forming the hole, excess material that may increase the size of the protrusion has already been removed. Therefore, the formation of burrs can be suppressed.

Preferably, the inner surface of the hole includes a side surface and a bottom surface. The groove is formed in the side surface of the hole, and extends in the depth direction of the hole.

As described above, the portion of steel on the bottom surface of the hole broken through by the plug may form the protrusion which is to be the starting point of burrs. However, as the protrusion moves to the billet rear end face side with the advance of the plug, the protrusion is absorbed by the groove extending in the longitudinal direction of the hole. Therefore, the formation of burrs is suppressed.

Preferably, the groove is formed in the bottom surface of the hole.

In this case, the portion of steel on the bottom surface of the hole, which has been broken through by the plug, is absorbed by the groove formed in the bottom surface of the hole before the protrusion is formed. Therefore, the formation of burrs can be suppressed.

Preferably, the step of forming the hole includes the steps of preparing a punch provided with a columnar part and a convex part which is formed on the surface of the columnar part and extends in the axial direction of the columnar part; and pushing the punch into the center at the rear end of the billet.

In this case, the hole having the aforementioned groove can be formed easily by the punch.

Preferably, the outside diameter of the columnar part increases gradually from the front end of the columnar part toward the rear end thereof.

In this case, the punch has a tapered shape. Therefore, after the punch has been pushed into the center at the rear end of the billet, the punch can be pulled out easily.

Preferably, the step of pushing the punch into the billet includes the steps of mounting the punch to the front end of a pushing rod of a pusher, which is disposed in front of the piercing mill and including the pushing rod for pushing the billet and a driving device for advancing the pushing rod; and pushing the punch into the center at the rear end of the billet by the pusher, and in the step of piercing and rolling the billet, the billet, in which the punch has been pushed, is advanced by the pusher to engage the billet with the plurality of conical rolls.

In this case, the aforementioned grooved hole can be formed by the pusher, and the billet can be engaged with the plurality of conical rolls.

The punch in accordance with the present invention is used in the above-described method of producing a seamless metal tube.

BEST MODE FOR CARRYING OUT THE INVENTION

Figure 1:
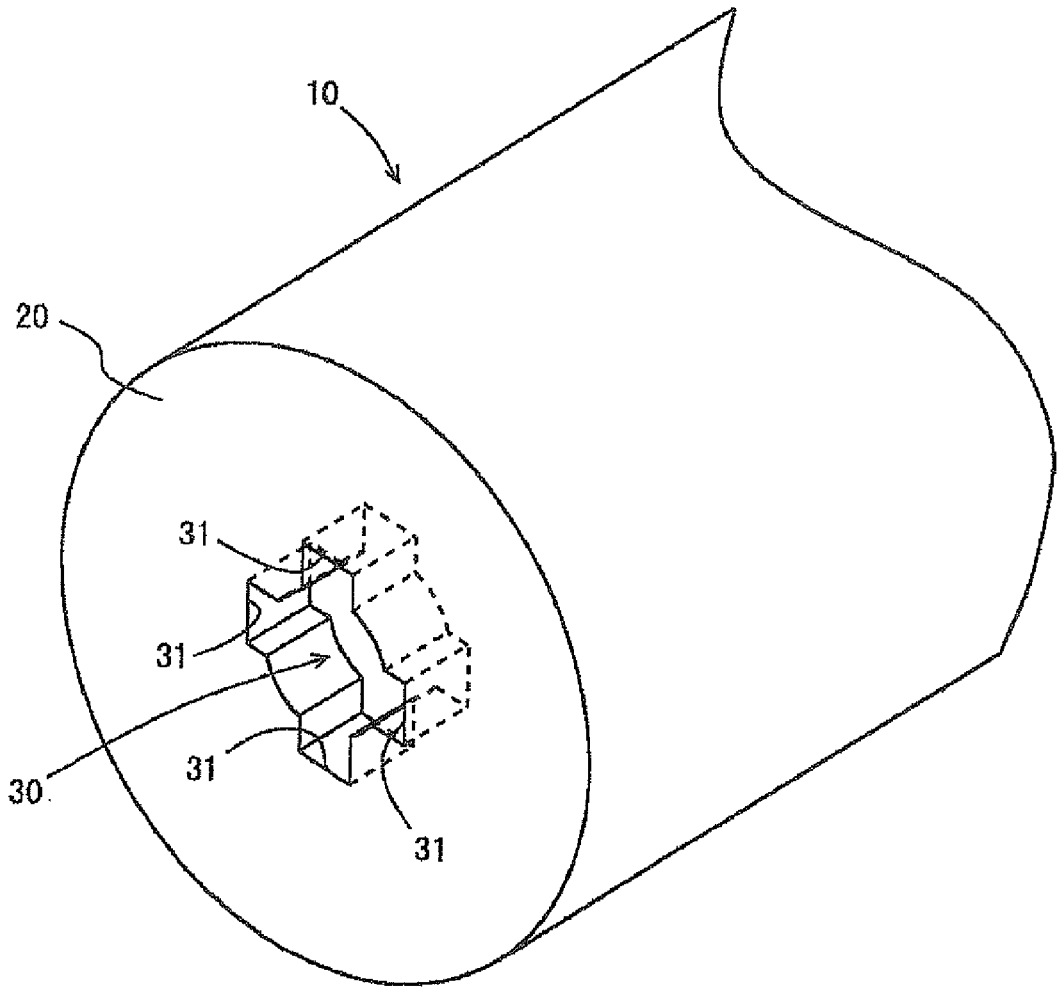
FIG. 1 is a perspective view of the rear end part of a round billet in accordance with an embodiment of the present invention.

Embodiments of the present invention will now be described in detail with reference to the accompanying drawings. In the drawings, the same reference numerals are applied to the same or equivalent elements, and the explanation of these elements is not repeated.

First Embodiment

Figure 2:
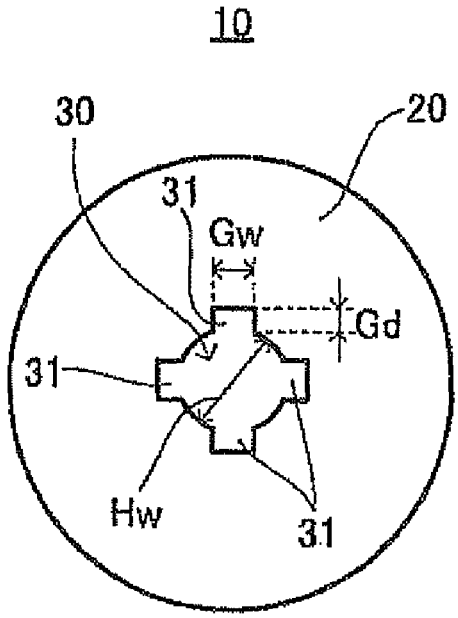
FIG. 2 is a front view of the round billet shown in FIG. 1.
Figure 3:
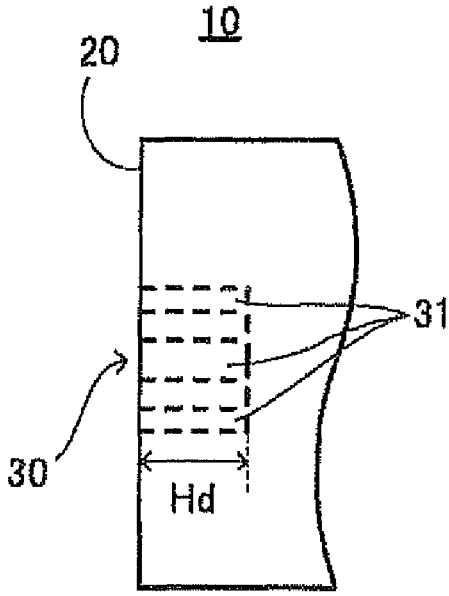
FIG. 3 is a side view of the round billet shown in FIG. 1.

With the method of producing a seamless metal tube in accordance with a first embodiment, a billet shown in FIGS. 1 to 3 is prepared, and piercing-rolling is performed by using the prepared round billet.

Referring to FIGS. 1 to 3, a hole 30 is formed in the center of a rear end face 20 of a round billet 10. The hole 30 has a predetermined depth from the rear end face 20. The hole 30 further has a plurality of grooves 31 in the side surface thereof. The grooves 31 extend along the depth direction of the hole. The grooves 31 are arranged at equal intervals around the axis of the round billet 10.

Figure 4:
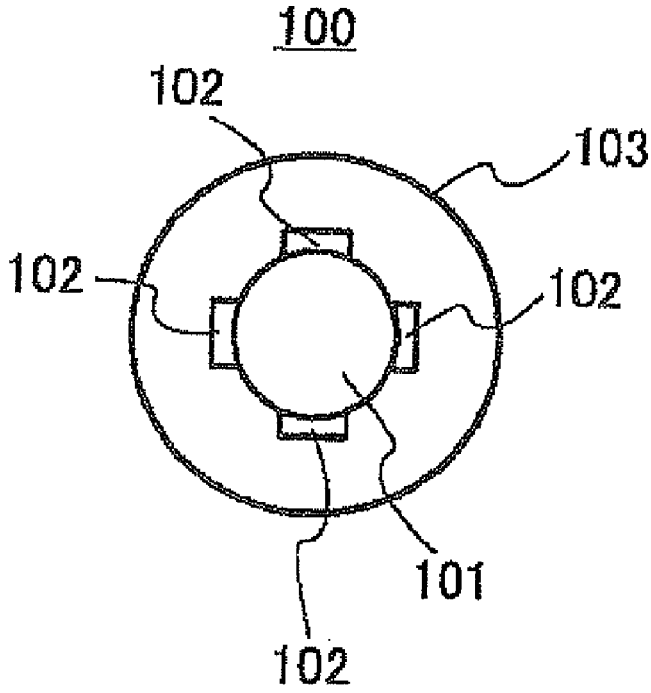
FIG. 4 is a front view of a punch for forming a hole shown in FIG. 1.
Figure 5:
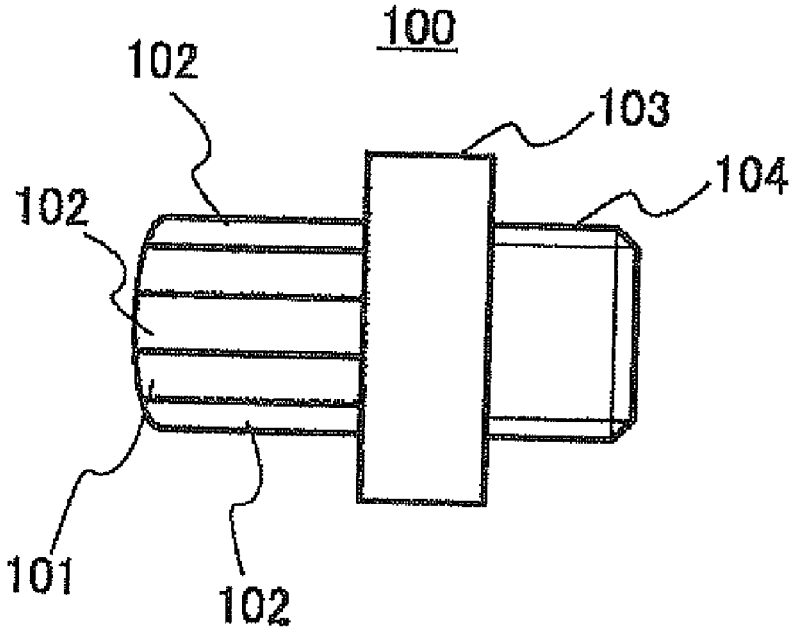
FIG. 5 is a side view of the punch shown in FIG. 4.

The hole 30 is formed by the method described below. A punch as shown in FIGS. 4 and 5 is prepared. Referring to FIGS. 4 and 5, a punch 100 includes a columnar part 101 and four convex parts 102 formed on the surface of the columnar part 101.

The columnar part 101 has a circular cross-sectional shape. The front end face of the columnar part 101 is rounded. The front end face of the columnar part 101 may be flat. The rear end of the columnar part 101 is fixed to one end of a columnar base 103. On the other end of the base 103, a fixing jig 104 is formed. The fixing jig 104 has, for example, an external thread.

The convex parts 102 are formed on the surface of the columnar part 101. The convex parts 102 extend in the axial direction of the columnar part 101. The convex parts 102 are arranged at equal intervals in the circumferential direction. The convex parts 102 play a role in forming the grooves 31 in the hole 30.

Figure 6:
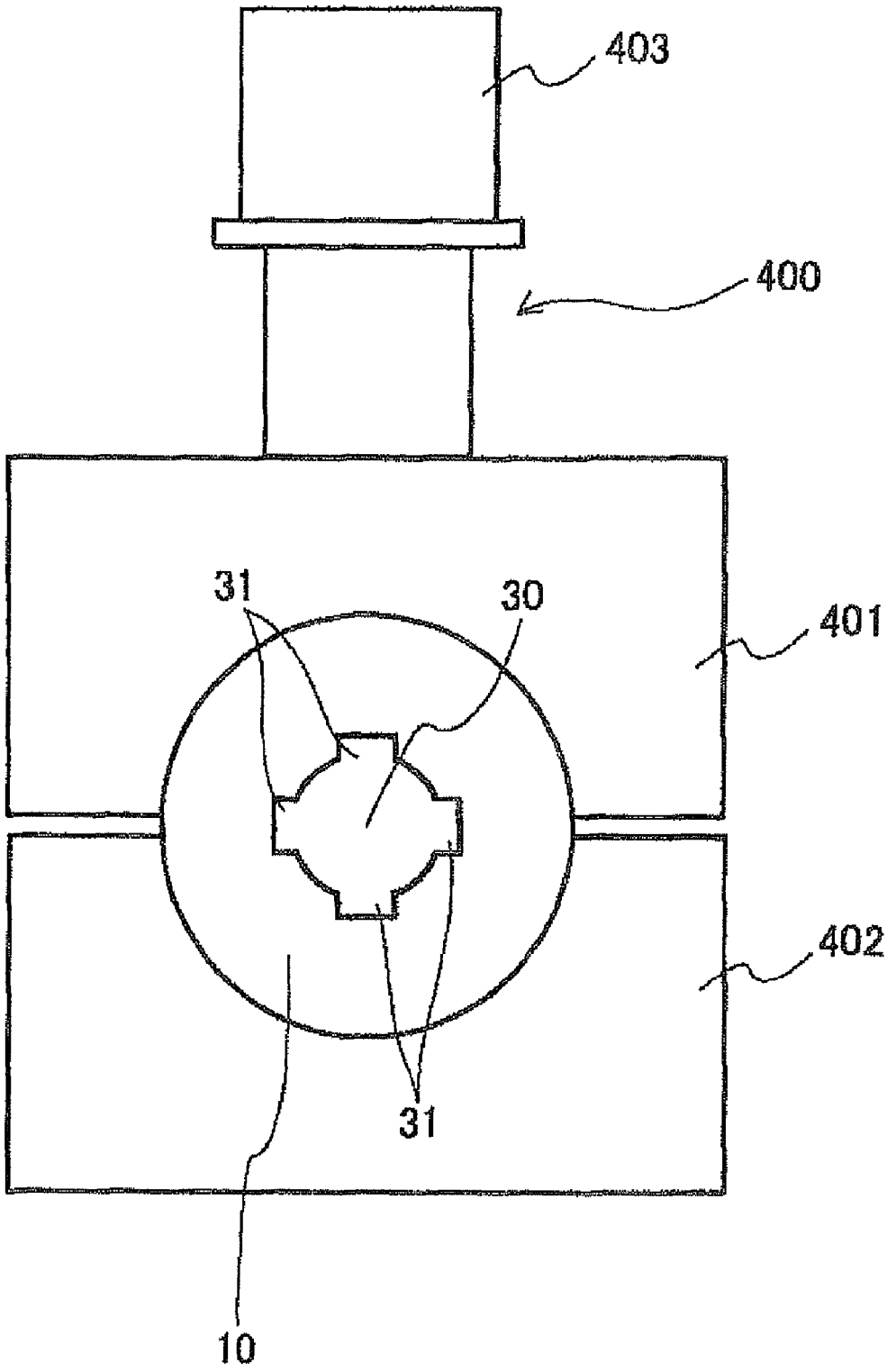
FIG. 6 is a front view of a clamp die for forming a hole shown in FIG. 1.

The method of forming the hole 30 using the aforementioned punch 100 is as described below. After the round billet 10 has been removed from a heating furnace, the round billet 10 is restrained by a clamp die 400 shown in FIG. 6. The clamp die 400 includes dies 401 and 402 having a circular hole and a driving device 403 for raising and lowering the die 401.

The punch 100 mounted to the front end of a hydraulic cylinder (not shown) is pushed into the center of the rear end face 20 of the restrained round billet 10 to form the hole 30. For example, on the front end surface of the hydraulic cylinder, an internal thread corresponding to the fixing jig 104 is formed, and the punch 100 is threadedly mounted to the front end of the hydraulic cylinder.

The hole 30 is formed by the above-described method. However, the hole 30 can be formed by any other method. For example, the hole 30 having the grooves 31 may be formed by fusing the center of the rear end surface of the round billet 10 by means of plasma gas or the like.

In FIG. 5, the columnar part 101 is of a cylindrical shape. The outside diameter of the columnar part 101 may be increased gradually from the front end thereof toward the rear end thereof. In this case, the punch 100 having been pushed into the rear end of the round billet 10 is easily removed.

Figure 7:
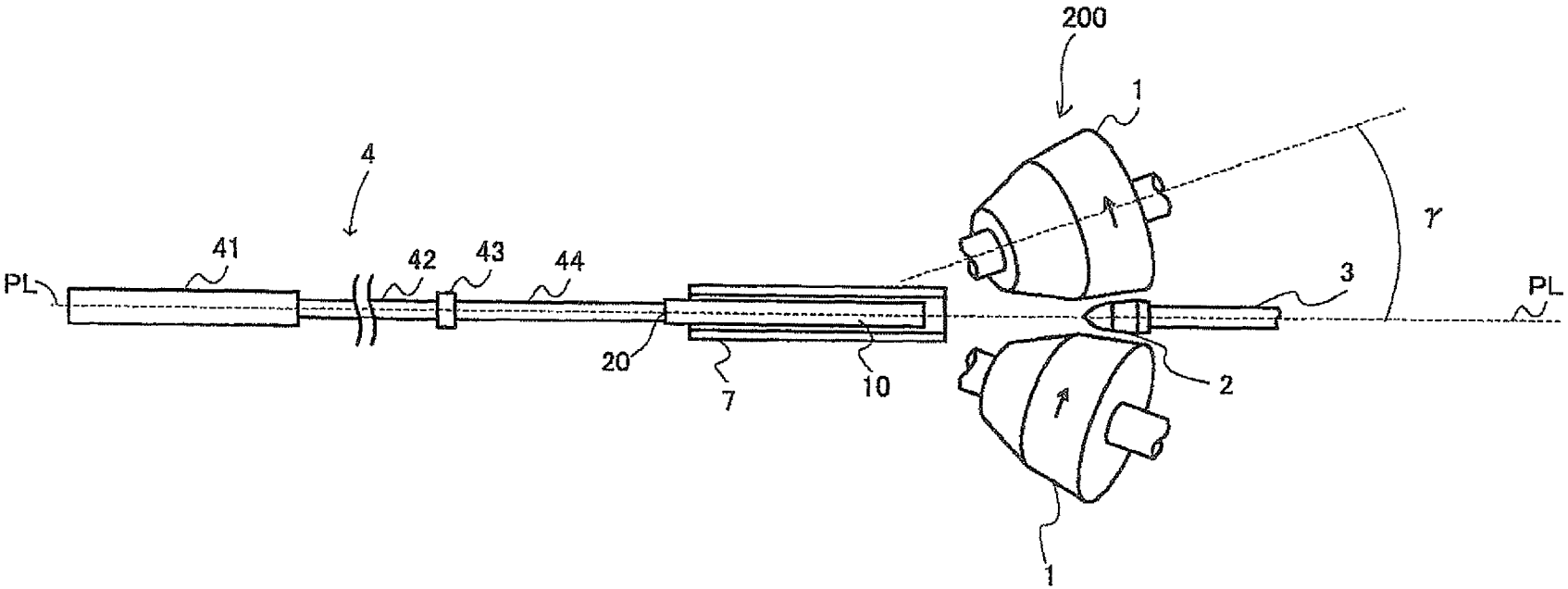
FIG. 7 is a schematic view showing a configuration of a piercing mill for piercing-rolling the round billet shown in FIG. 1 and a pusher.
Figure 8:
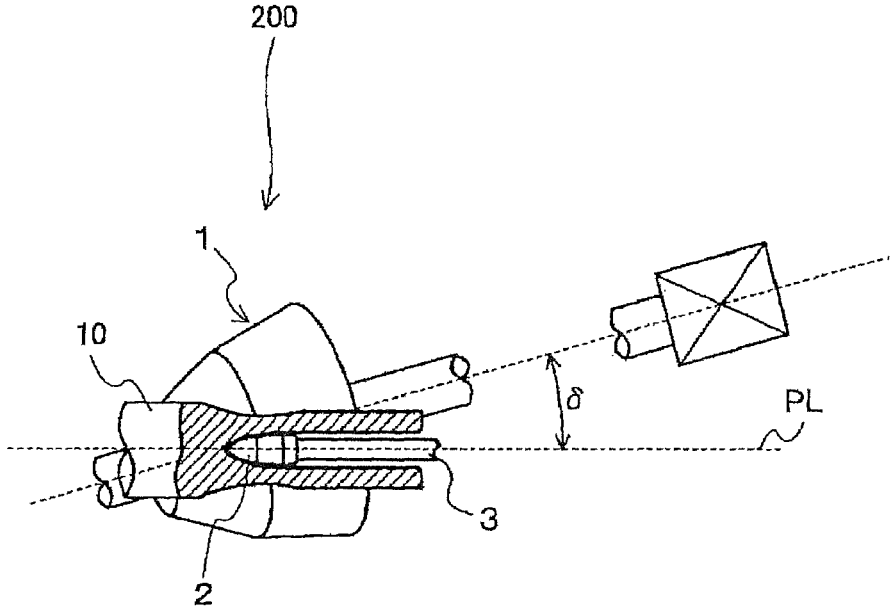
FIG. 8 is a side view of the piercing mill shown in FIG. 7.

After the hole 30 has been formed, the round billet 10 is pierced and rolled by using a piercing mill. Referring to FIGS. 7 and 8, a piercing mill 200 includes two cone-shaped conical rolls (hereinafter, referred simply as to conical rolls) 1, a plug 2, and a core bar 3.

The two conical rolls 1 are disposed opposedly with a pass line PL being held therebetween. Each of the conical rolls 1 has a feed angle $\delta$ and a toe angle $\gamma$ with respect to the pass line PL. The plug 2 is disposed on the pass line PL between the two conical rolls 1. The core bar 3 is disposed along the pass line PL on the outlet side of the piercing mill 200, and the front end thereof is connected to the rear end of the plug 2.

A pusher 4 is disposed along the pass line PL in front of the inlet side of the piercing mill 200. The pusher 4 includes a cylinder body 41, a cylinder shaft 42, a connecting member 43, and a billet pushing rod 44. The billet pushing rod 44 is connected to the cylinder shaft 42 by the connecting member 43 so as to be rotatable in the circumferential direction. The connecting member 43 includes a bearing for allowing the billet pushing rod 44 to rotate in the circumferential direction.

The cylinder body 41, being a driving device, is of a hydraulic type or an electrically powered type, and advances and retreats the cylinder shaft 42. The pusher 4 butts against the rear end face 20 of the round billet 10 on the front end face of the billet pushing rod 44 and pushes the round billet 10 by causing the cylinder shaft 42 and the billet pushing rod 44 to advance by means of the cylinder body 41.

On the pass line PL between the pusher 4 and the conical roll 1, an entrance guide 7 is disposed. The entrance guide 7 suppresses deviation of the round billet 10 from the pass line PL while the pusher 4 is pushing the round billet 10 to advance.

The round billet 10 having the hole 30 is placed on the pass line PL between the conical roll 1 and the pusher 4. At this time, the rear end face 20 of the round billet 10 faces to the pusher 4, and the front end face thereof faces to the plug 2.

The pusher 4 pushes the round billet 10 forward along the pass line PL, and pushes it in between the two conical rolls 1. The round billet 10 is engaged with the two conical rolls 1. The round billet 10 advances while being spirally rotated by the conical rolls 1, and the plug 2 is pushed into the axis of the round billet 10. Thus, the round billet 10 is pierced and rolled by the plug 2 and the conical rolls 1.

In the case where the round billet 10 having the hole 30 is pierced and rolled into a hollow shell, burrs are less liable to be produced at the rear end of the hollow shell. As the reason for this, the following is presumed.

Figure 9:
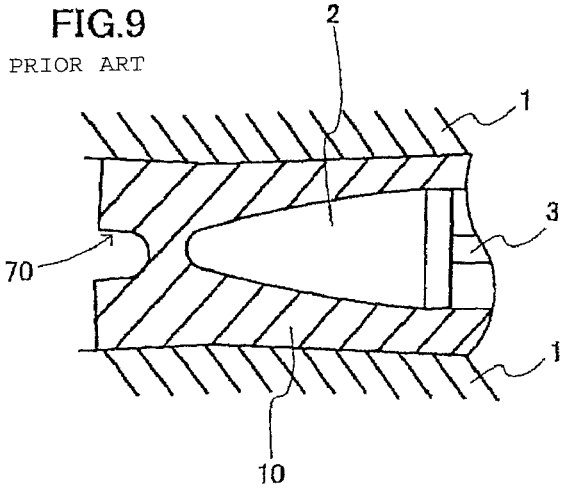
FIG.9 PRIOR ART
FIG. 9 is an explanatory view for explaining a mechanism by which burrs are produced by piercing-rolling.
Figure 10:
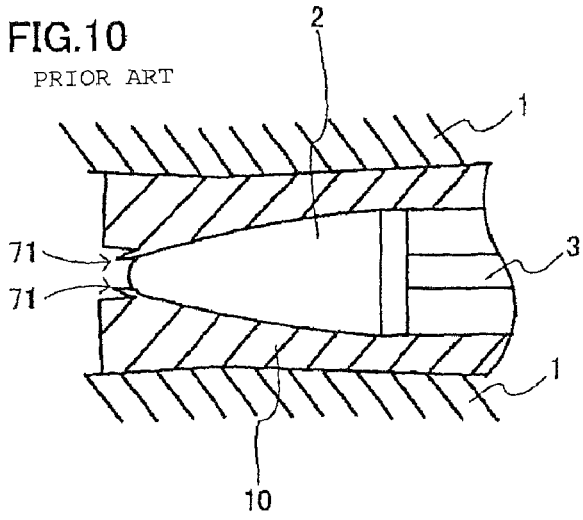
FIG.10 PRIOR ART
FIG. 10 is an explanatory view for explaining a process following the process shown in FIG. 9.
Figure 11:
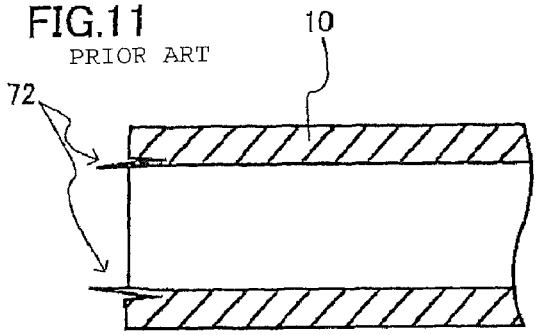
FIG.11 PRIOR ART
FIG. 11 is an explanatory view for explaining a process following the process shown in FIG. 10.

In the prior art, as shown in FIG. 9, the material of the rear end center that may become an excess material (an amount of the material of billet jutted out by plug piercing) is removed in advance to form a hole 70. However, as shown in FIG. 10, when the front end of the plug 2 breaks through the bottom surface of the hole 70, a portion of steel near the bottom surface of the hole 70 is torn up, and a protrusion 71 is formed. Since the inner surface of the hole 70 is a smooth surface having no groove, once the protrusion 71 is formed, the protrusion 71 grows as the plug 2 advances. As a result, as shown in FIG. 11, burrs 72 are produced at the rear end of the piercing-rolled hollow shell.

On the other hand, in the case where the round billet 10 is formed with the hole 30, the grooves 31 are formed in the side surface of the hole 30. When the front end of the plug 2 that is performing piercing breaks through the bottom surface part of the hole 30, as in the case shown in FIG. 10, a portion of steel broken through by the front end of the plug 2 tends to form a protrusion. However, since the grooves 31 are formed in the side surface of the hole 30, the portion of steel tending to form the protrusion is absorbed by the grooves 31 as the plug 2 advances. Since the grooves 31 absorb the portion of steel tending to form the protrusion, burrs are less liable to be produced at the rear end of the pierced and rolled billet 10.

For the above reason, by the formation of the hole 30 having the grooves 31, burrs can be restrained from being produced on the pierced and rolled hollow shell. Therefore, in the case where the hollow shell is rolled into a predetermined size by using an elongator, a sizing mill, and the like to produce a seamless metal tube, inner surface flaws are less liable to be induced on the seamless metal tube.

When Db (mm) is the outside diameter of the round billet 10, Hd (mm) is the depth of the hole 30, Hw (mm) is the diameter of the hole 30, Gw (mm) is the width of the groove 31, and Gd (mm) is the depth of the groove 31, the following formulas (1) to (4) are preferably satisfied:

$$Hw/Db \geqq 0.11 \quad (1)$$

$$Hd/Db \geqq 0.10 \quad (2)$$

$$Gw/Db \geqq 0.04 \quad (3)$$

$$Gd/Db \geqq 0.02 \quad (4)$$

However, even in the case where formulas (1) to (4) are not satisfied, the production of burrs can be suppressed to some extent.

Figure 12:
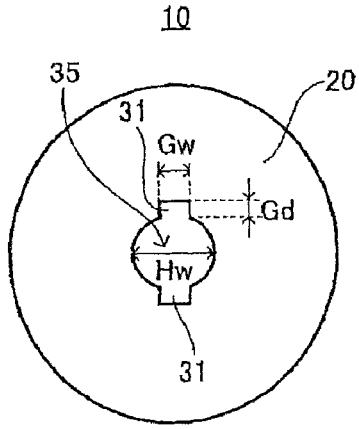
FIG. 12 is a front view of a round billet formed with a hole having a shape different from the shape shown in FIG. 1.
Figure 13:
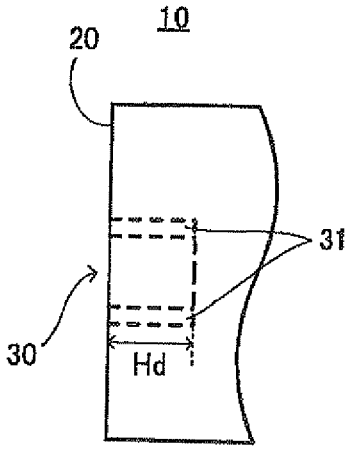
FIG. 13 is a side view of the round billet shown in FIG. 12.

In FIGS. 1 to 3, four grooves 31 are formed in the hole 30; however, the number of grooves may be one or more. For example, as shown in FIGS. 12 and 13, a hole 35 having two grooves 31 opposed to each other may be formed in the round billet 10.

Also, in this embodiment, the hole 30 is of a columnar shape; however, the shape of the hole 30 may be a truncated cone shape or cone shape such that the diameter decreases gradually from the opening part of the hole 30 toward the bottom surface thereof. Also, the bottom surface of the hole 30 may be concavely rounded.

Second Embodiment

Figure 14:
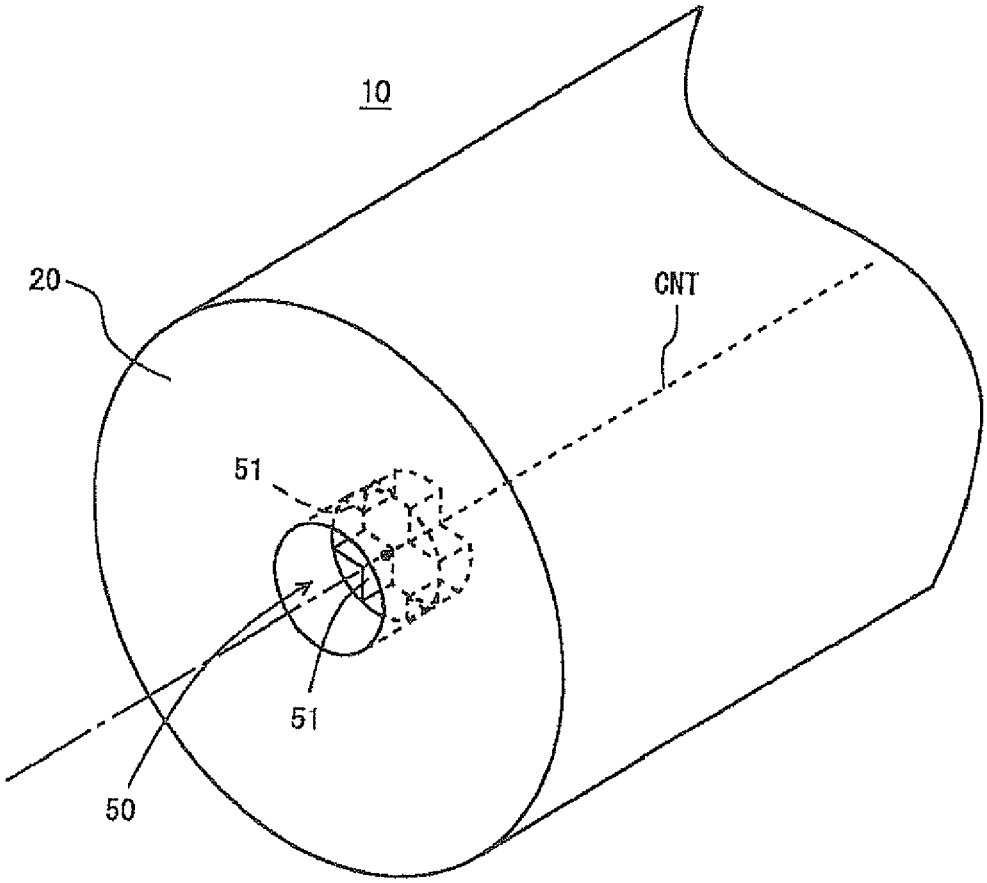
FIG. 14 is a perspective view of a round billet formed with a hole having a shape different from the shapes shown in FIGS. 1 and 12.
Figure 15:
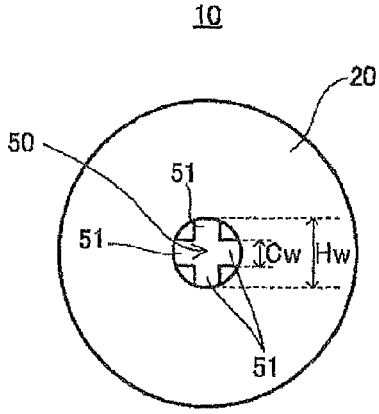
FIG. 15 is a front view of the round billet shown in FIG. 14.
Figure 16:
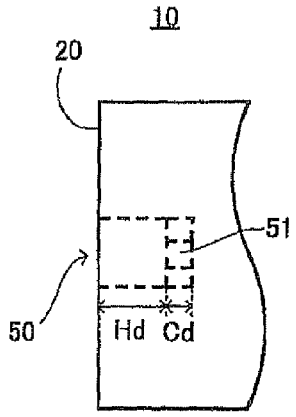
FIG. 16 is a side view of the round billet shown in FIG. 14.

In the method of producing a seamless metal tube in accordance with a second embodiment, the round billet 10 is formed with a hole 50 shown in FIGS. 14 to 16.

The hole 50 is formed in the center of the rear end face 20. The hole 50 has a predetermined depth from the rear end face 20. The hole 50 is formed with a plurality of grooves 51 in the bottom surface thereof. In FIGS. 14 to 16, two grooves 51 intersect at right angles. Also, the grooves 51 are formed so as to intersect with the axis CNT of the round billet 10. No groove is formed in the side surface of the hole 50.

The method of forming the hole 50 is the same as the method in the first embodiment. Specifically, a punch having a convex part corresponding to the grooves 51 on the front end surface of a columnar part is pushed into the rear end of the heated round billet 10 to form the hole 50.

The round billet 10 formed with the hole 50 is pierced and rolled in the same way as described in the first embodiment. That is, the front end of the round billet 10 is pushed in between the conical rolls 1 to perform piercing-rolling.

The round billet 10 has the hole 50 formed with the grooves 51 in the bottom surface thereof. Therefore, burrs are less liable to be produced at the rear end of the hollow shell produced by piercing-rolling. As the reason for this, the following is presumed.

When the front end of the plug 2 that is piercing the round billet 10 breaks through the bottom surface of the hole 50, the front end of the plug 2 breaks through a region in which the grooves 51 intersect with the axis CNT. At this time, a broken-through portion of steel tends to form a protrusion, but the portion of steel tending to form the protrusion is absorbed by the grooves 51. Further, the excess material that grows the protrusion has been removed already because the hole 50 is formed. That is, the production of the protrusion that may become the starting point of burrs is suppressed by the grooves 51, and further, the growth of the protrusion is suppressed by the hole 50. Therefore, the production of burrs is suppressed.

The number of the grooves 51 formed in the bottom surface of the hole 50 may be one or may be three or more.

Third Embodiment

Figure 17:
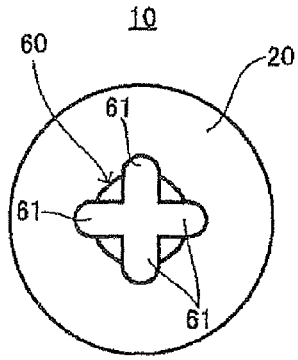
FIG. 17 is a front view of a round billet formed with a hole having a shape different from the shapes shown in FIGS. 1, 12 and 14.
Figure 18:
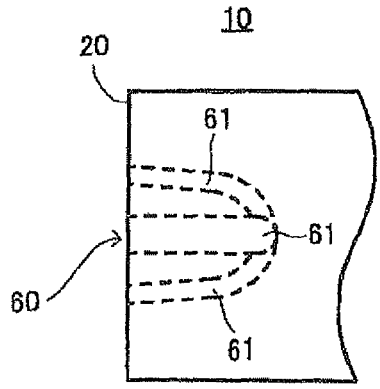
FIG. 18 is a side view of the round billet shown in FIG. 17.

In the side surface and the bottom surface of a hole formed in the rear end face 20 of the round billet 10, one or a plurality of grooves may be formed. For example, as shown in FIGS. 17 and 18, a plurality of grooves 61 may be formed in the side surface and the bottom surface of a hole 60. At this time, a portion of the groove 61 formed in the bottom surface intersects with the axis of the round billet.

When the front end of the plug 2 that is piercing the round billet 10 breaks through the bottom surface of the hole 60, a broken-through portion of steel tends to form a protrusion, but the portion of steel tending to form the protrusion is absorbed by the grooves 61 formed in the bottom surface and the side surface of the hole 60. Therefore, the production of burrs is suppressed.

Fourth Embodiment

The punch used in the above-described embodiments may be mounted to the front end of the pusher 4. Hereunder, a method of forming the hole 60 shown in FIGS. 17 and 18 by using a punch mounted on the pusher 4 is described. The same holds true for the holes 30, 35, and 50 having a different shape.

Figure 19:
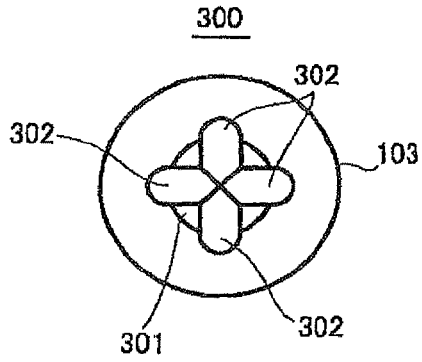
FIG. 19 is a front view of a punch for forming the hole shown in FIG. 17.
Figure 20:
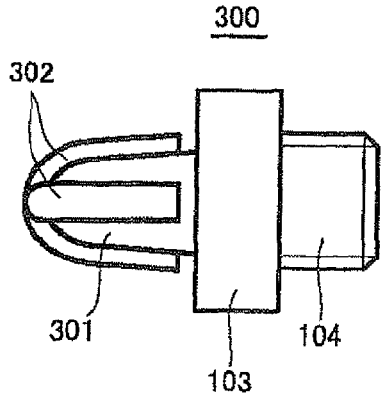
FIG. 20 is a side view of the punch shown in FIG. 19.

Referring to FIGS. 19 and 20, a punch 300 includes a columnar part 301 and four convex parts 302 formed on the surface of the columnar part 301.

The cross-sectional shape of the columnar part 301 is circular, and the front end of the columnar part 301 is rounded. Also, the outside diameter of the columnar part 301 increases gradually from the front end toward the rear end. The columnar part 301 is mounted on the base 103.

The convex parts 302 are formed on the surface of the columnar part 301. Also, the convex parts 302 extend in the axial direction of the columnar part 301. The convex parts 302 are arranged at equal intervals in the circumferential direction.

Figure 21:
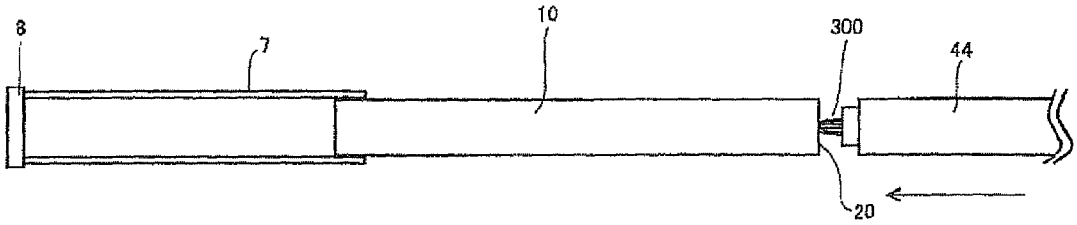
FIG. 21 is a schematic view for explaining a method of forming a hole using the punch shown in FIG. 19.

As shown in FIG. 21, the punch 300 is mounted to the front end of the billet pushing rod 44 of the pusher 4. In the center of the front end face of the billet pushing rod 44, an internal thread corresponding to the fixing jig 104 is formed. The punch 300 is threadedly mounted to the front end of the billet pushing rod 44 and is fixed. Between the punch 300 and the billet pushing rod 44, a thrust bearing may be disposed.

After the punch 300 has been mounted, the round billet 10 not formed with a hole on the rear end face thereof is placed on the pass line PL between the piercing mill 200 and the pusher 4. Also, a shield plate 8 is mounted to the outlet (i.e., of the two end parts of the entrance guide 7, an end part close to the conical rolls 1) of the entrance guide 7.

After the shield plate 8 has been mounted, the round billet 10 is pushed forward by the pusher 4. Even after the front end face of the round billet 10 has come into contact with the shield plate 8, the pusher 4 continues to push the round billet 10. The punch 300 mounted to the front end of the billet pushing rod 44 is pushed in the center of the rear end face of the round billet 10, whereby the hole 60 is formed.

When the punch 300 is pushed in the rear end face of the round billet 10, the pusher 4 stops pushing the round billet 10. After the shield plate 8 has been removed, the pusher 4 pushes the round billet 10 forward again. As a result, the round billet 10 is engaged with the conical rolls 1, and piercing-rolling is started. At this time, the pusher 4 stops the pushing the round billet 10. The round billet 10 is pierced, rolled and advanced, so that the punch 300 comes off the rear end face of the round billet 10. When the round billet 10 is rotated in the circumferential direction by the conical rolls 1, the punch 300 is also rotated together with the round billet 10 by the connecting member 43.

The columnar part 301 of the punch 300 has a so-called tapered shape such that the outside diameter increases gradually from the front end toward the rear end. Therefore, at the time of piercing-rolling, the punch 300 easily comes off the round billet 10.

Figure 22:
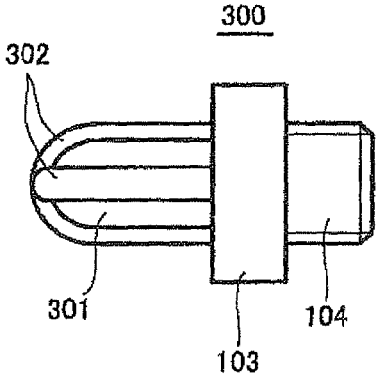
FIG. 22 is a side view of a punch having a shape different from the shape shown in FIG. 20.

In the above-described method, the columnar part 301 has a tapered shape; however, for example, as shown in FIG. 22, the columnar part 301 may be of a cylindrical shape. However, the columnar part 301 having a tapered shape comes off the round billet 10 more easily.

EXAMPLES

A plurality of round billets were prepared. The outside diameter of each of the round billets was 70 mm, and the material thereof was a carbon steel for machine structure purposes (corresponding to S45C of JIS standard). In the center on the rear end face of each of the prepared round billets, a hole having a shape given in Table 1 was formed by electrical discharge machining. [Table 1]

TABLE 1

| | | No. | | | | | | | | | |
|---|---|---|---|---|---|---|---|---|---|---|---|
| | | 1 | 2 | 3 | 4 | 5 | 6 | 7 | 8 | 9 | 10 |
| Hole Type | | Cylindrical | Hole 30 | | | | | | Hole 35 | | Hole 50 |
| Hole Dimension | Hw (mm) | 12 | 12.0 | 12.0 | 12.0 | 8.0 | 8.0 | 12.0 | 12.0 | 16.0 | 12.0 |
| | Hd (mm) | 12 | 12.0 | 12.0 | 8.0 | 12.0 | 12.0 | 8.0 | 12.0 | 16.0 | 12.0 |
| | Gw (mm) | — | 3.0 | 4.0 | 4.0 | 4.0 | 5.0 | 5.0 | 5.0 | 5.0 | — |
| | Gd (mm) | — | 1.5 | 2.0 | 2.0 | 2.0 | 2.5 | 2.5 | 2.5 | 2.5 | — |
| | Cw (mm) | — | — | — | — | — | — | — | — | — | 6.0 |
| | Cd (mm) | — | — | — | — | — | — | — | — | — | 6.0 |
| Hole Dimension Ratio | Hw/Db | 0.17 | 0.17 | 0.17 | 0.17 | 0.11 | 0.11 | 0.17 | 0.17 | 0.23 | 0.17 |
| | Hd/Db | 0.17 | 0.17 | 0.17 | 0.11 | 0.17 | 0.17 | 0.11 | 0.17 | 0.23 | 0.17 |
| | Gw/Db | — | 0.04 | 0.06 | 0.06 | 0.06 | 0.07 | 0.07 | 0.07 | 0.07 | — |
| | Gd/Db | — | 0.02 | 0.03 | 0.03 | 0.03 | 0.04 | 0.04 | 0.04 | 0.04 | — |
| | Cw/Db | — | — | — | — | — | — | — | — | — | 0.09 |
| | Cd/Db | — | — | — | — | — | — | — | — | — | 0.09 |
| Burr Formation Ratio (%) | (%) | 100 | 40 | 0 | 40 | 20 | 0 | 40 | 40 | 0 | 0 |

Referring to Table 1, the "Hole type" column indicates the kind of hole formed in a billet of each number. "Cylindrical" indicates that the hole shape is cylindrical, assuming the conventional example. "Hole 30" indicates that the hole 30 having the four grooves 31 on the side surface thereof is formed as shown in FIGS. 1 to 3. "Hole 35" indicates that the hole 35 having the two grooves 31 on the side surface thereof is formed as shown in FIGS. 12 and 13. "Hole 50" indicates that the hole 50 having the grooves 51 on the bottom surface thereof is formed as shown in FIGS. 14 to 16.

"Hole dimension" in Table 1 indicates the dimensions of each hole. As shown in FIGS. 2, 3, 12, 13, 15 and 16, "Hw" indicates the diameter (mm) of each hole, and "Hd" indicates the depth (mm) of each hole. "Gw" indicates the width (mm) of the groove formed in the side surface of the hole, and "Gd" indicates the depth (mm) of the groove. "Cw" indicates the width (mm) of the groove formed in the bottom surface of the hole, and "Cd" indicates the depth (mm) of the groove.

"Hole dimension ratio" in Table 1 indicates the ratios of the hole dimensions to the round billet diameter Db (=70 mm).

Five round billets were prepared for each billet number. The round billets were pierced and rolled under the same conditions by using the piercing mill having the configuration shown in FIG. 7. Specifically, the round billets were heated by a heating furnace. At this time, the heating temperature was set at 1200° C. The heated round billet was pierced and rolled to form a hollow shell having an outside diameter of 81 mm and a wall thickness of 11 mm.

It was judged visually whether or not burrs had been formed at the rear end of the produced hollow shell. For each billet number, the ratio of the number P of billets on which burrs are formed to the number of pierced and rolled billets (five billets) (=P/5) was determined as a burr formation ratio (%).

The determined burr formation ratio is given in Table 1. Referring to Table 1, on the round billet of No. 1, which is the conventional example, the burr formation ratio was 100%; on all of the five round billets, burrs were formed. On the other hand, on the round billets of No. 2 to No. 10, the burr formation ratio was 40% or less.

The above is a description of the embodiments of the present invention. The above-described embodiments are merely illustrative examples for carrying out the present invention. Therefore, the present invention is not limited to the above-described embodiments, and can be carried out with an appropriate change of the above-described embodiments without departing from the spirit and scope of the present invention.

The invention claimed is:

1. A method of producing a seamless metal tube by using a piercing mill including a plurality of conical rolls and a plug disposed between the plurality of conical rolls, the method comprising the steps of:

preparing a billet;

forming a hole, which has a predetermined depth in an axial direction of the billet and has a groove in an inner surface thereof, in a center at a rear end of the billet; and piercing and rolling the billet from a front end of the billet by the piercing mill after forming the hole at the rear end of the billet.

2. The method of producing a seamless metal tube according to claim 1, wherein the groove is formed in a side surface of the hole, and extends in a depth direction of the hole.

3. The method of producing a seamless metal tube according to claim 2, wherein the step of forming the hole comprises the steps of:

preparing a punch including a columnar part and a convex part which is formed on a surface of the columnar part and extends in an axial direction of the columnar part; and pushing the punch into the center at the rear end of the billet.

4. The method of producing a seamless metal tube according to claim 3, wherein the step of pushing the punch into the billet comprises the steps of:

mounting the punch to a front end of a pushing rod of a pusher, which is disposed in front of the piercing mill and is provided with the pushing rod for pushing the billet and a driving device advancing the pushing rod; and pushing the punch into the center at the rear end of the billet by the pusher, and the step of piercing and rolling the billet comprises a step of:

advancing the billet, in which the punch has been pushed, by the pusher to engage the billet with the plurality of conical rolls.

5. The method of producing a seamless metal tube according to claim 3, wherein an outside diameter of the columnar part increases gradually from a front end of the columnar part toward a rear end thereof.

6. The method of producing a seamless metal tube according to claim 2, wherein the groove is further formed in a bottom surface of the hole.

7. The method of producing a seamless metal tube according to claim 1, wherein the groove is formed in a bottom surface of the hole.

* * * * *